United States Patent [19]

Waggoner

[11] Patent Number: 4,923,160

[45] Date of Patent: May 8, 1990

[54] CAMMING MEANS FOR CLIMBING ANCHORS

[76] Inventor: David L. Waggoner, P.O. Box 5353, Durango, Colo. 81302

[21] Appl. No.: 278,813

[22] Filed: Dec. 2, 1988

[51] Int. Cl.[5] ..... F16M 11/00

[52] U.S. Cl. ..... 248/200; 248/231.9; 248/925

[58] Field of Search ..... 248/1, 231.9, 231.91, 248/200, 205.1, 925, 694; 267/156, 275

[56] References Cited

U.S. PATENT DOCUMENTS

| | | | |
|---|---|---|---|
| 2,934,785 | 5/1960 | Heuer | 267/156 X |
| 3,877,679 | 4/1975 | Lowe | 254/135 |
| 4,184,657 | 1/1980 | Jardine | 248/1 |
| 4,491,291 | 1/1985 | Ching | 248/1 |
| 4,565,342 | 1/1986 | Grow | 248/1 |
| 4,572,464 | 2/1986 | Phillips | 248/1 |
| 4,575,032 | 3/1986 | Taylor | 248/1 |
| 4,586,686 | 5/1986 | Cason | 248/1 |
| 4,643,377 | 2/1987 | Christianson | 248/1 |
| 4,643,378 | 2/1987 | Guthrie | 248/1 |
| 4,645,149 | 2/1987 | Lowe | 248/1 |
| 4,781,346 | 11/1988 | Banner | 248/1 |

FOREIGN PATENT DOCUMENTS

| | | | |
|---|---|---|---|
| 226829 | 7/1987 | European Pat. Off. | 248/1 |
| 2567594 | 1/1986 | France | 248/1 |
| 2158540 | 11/1985 | United Kingdom | 248/1 |

*Primary Examiner*—David L. Talbott

*Attorney, Agent, or Firm*—Kenton L. Freudenberg; Maxwell C. Freudenberg

[57] ABSTRACT

An improved climbing anchor utilizing multiple cam elements in which each cam element is independently spring biased by a flat spiral spring located within a recess in the cam element and acting between the pivot mounting and the cam element. The construction provides a more compact camming head assembly, a stronger climbing anchor, more positive action of the spring biasing means and an improved visual appearance.

24 Claims, 3 Drawing Sheets

Fig. 3
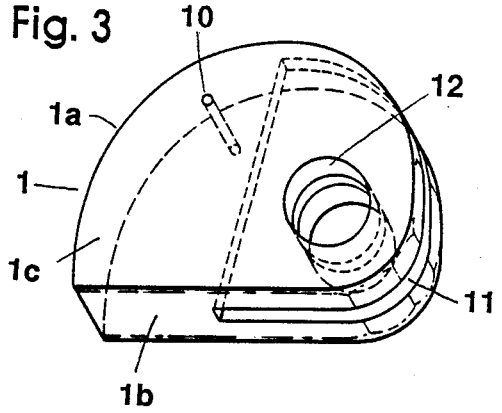
Fig. 4
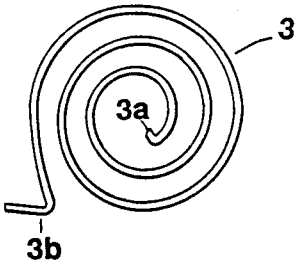
Fig. 5
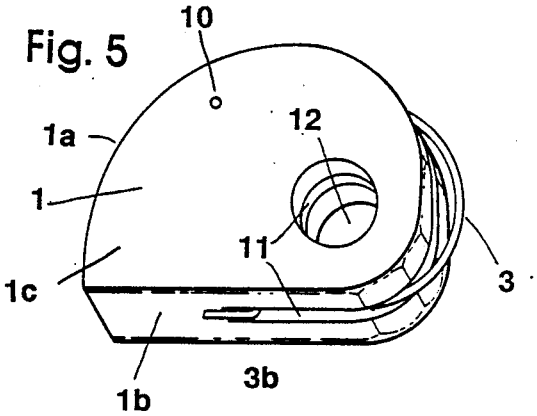
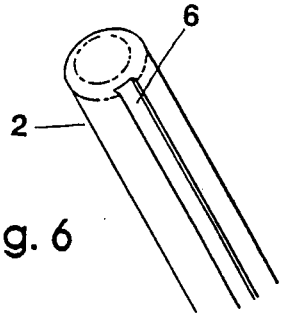
Fig. 6
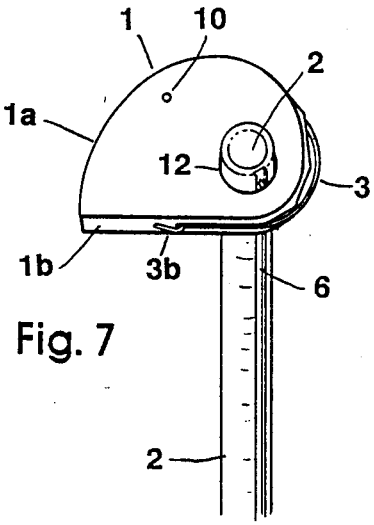
Fig. 7
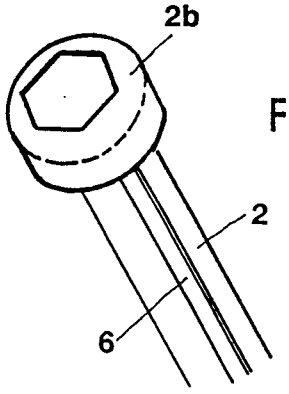
Fig. 8

CAMMING MEANS FOR CLIMBING ANCHORS

BACKGROUND OF THE INVENTION

Numerous devices have been devised to assist climbers in securing ropes to cracks in rock walls for the purpose of climbing safety. Devices which have recently come into common use incorporate multiple pivoting cams which are spring biased toward their open position to allow placement of these devices securely into cracks and crevices of varying sizes. Because such devices can be subject to substantial loads in holding a falling climber, it is desirable to construct such anchors in a manner which provides the greatest possible structural integrity of the device. The present invention introduces a construction of climbing anchor which provides an improvement in structural integrity over the prior art along with other related benefits.

SUMMARY OF THE INVENTION

The present application relates to an improvement over existing climbing anchors which use camming structures which are actively spring biased. Incorporated herein by reference is previous application, Ser. No. 07/084,984, filed Aug. 11, 1987 for "ANCHORING DEVICE FOR USE IN CREVICES" by the applicant herein.

Prior art climbing devices utilizing spring biased camming elements are described in the following U.S Pat. Nos.:

| | |
|---|---|
| Jardine | 4,184,657 |
| Lowe | 3,877,679 |
| Lowe | 4,645,149 |
| Taylor | 4,575,032 |
| Christianson | 4,643,377 |
| Grow | 4,565,342 |
| Cason | 4,586,686 |

Each of the preceding patents shows a device using a head having one or more spring biased cams which can be wedged between the opposite walls of a crack or crevice in a rock structure being climbed. The cams are biased to an open position corresponding generally to the maximum spacing between the opposed walls and can be manually retracted to a closed position for convenient insertion into the crack. Upon release of the manual retracting force the cams move toward the open position until they engage the opposite walls. Other climbing devices have used wedging means in place of the camming means described above. An example of a climbing anchor using wedging means is shown in Phillips, U.S. Pat. No. 4,572,464. As used herein any reference to cams or camming is deemed to include wedges or wedging where appropriate within the spirit of the present invention.

In each of these prior art patents the camming elements are pivoted on a shaft or axle which is in turn attached to the head supporting structure or structures of the anchor either at each end of the shaft or at its middle. The spring biasing means of Jardine, Taylor, Grow, Cason and an alternative embodiment of Christianson comprise a spring, coiled helically around this shaft, engaged at its ends with opposing cam elements and acting in a torsional fashion. Each of the Lowe patents shows embodiments incorporating multiple cam elements where the biasing means comprises a coil spring having a coil diameter substantially larger than the diameter of the wire material of which it is constructed and attached in a linear fashion between two opposing cam elements to act in tension to bias the cam elements against one another. The preferred embodiment of Lowe U.S. Pat. No. 3,877,679 shows a similar coiled spring used in tension between a single cam element 12 and its corresponding support bar 14. The length of shaft occupied by the coiled spring or springs of the prior art devices requires the shaft to be of sufficient length to accommodate both the camming elements and the separate coiled spring(s)and generally requires that the cam elements be sufficiently far apart from each other or from the supporting member of the shaft to allow space for the helical springs as shown at 3*c* in FIG. 2. In contrast, construction of a climbing anchor according to the present invention allows for a camming head which is much more compact in its axial width by using a flat thin spring biasing means located within a recess in each cam. A spring constructed and positioned in this manner takes up no additional axial length on the pivot shaft. Because a relatively small diameter spring wire is used to form the flat spring biasing means, and the corresponding recess within a cam element is relatively narrow, the external dimensions of each cam element need be no greater than those of a corresponding prior art cam element. The material from which the cam elements are formed has a very high compressive strength. Therefore, even though a small internal portion of a cam element is removed in creating the recess, the substantial portion of remaining wall thickness is sufficiently strong to resist the high compressive forces on the cam element which may be encountered during use of the anchor.

In use, the prior art devices such as those described are typically anchored in natural cracks or crevices in a rock wall. These cracks are, of course, of widely varying shapes and sizes. In order to allow secure placement of camming devices it is an advantage to have a camming head which is not only adjustable to fit cracks of varying widths but which is otherwise as axially compact as possible, i.e., where the width of the device to the outermost edges of the cam elements, in a direction parallel to the shaft upon which they pivot, is minimized. The compactness of such a device allows its use in some difficult placements where a prior art device sized to fit cracks of similar width might not be usable. Such difficult placements include cracks which are not straight, where a prior art device of the proper width range has too great an axial length between the outermost cams and, because of this unnecessary length, will not fit into a curved or irregular portion of such a crack. Another such difficult placement is in a cavity which may be essentially a hole rather than a crack, and may have only a short length of sufficient width for the insertion of an anchor. Also, where the walls of a crack converge or diverge so that over a distance equal to the width spanned by the cam elements of the head parallel to the shaft upon which they pivot, the convergence or divergence of the crack may exceed the usable range of the anchoring device. By making the camming head of an anchor as compact as possible as described above, the potential for useful placement of a particular device is substantially increased.

It is well understood that to absorb sufficient energy to stop a falling climber, a climbing anchor must withstand dynamic loads far exceeding the static load equal to the weight of a climber. A dynamic load of, for example, 1000 pounds can be readily exerted on an anchor during a hard fall. In all active camming devices such as those described above, the shaft on which the camming elements pivot must bear any load to which the device may be subjected. Additionally, because of the action of the camming elements, the shaft of an active camming device can be subjected to bending forces greater than the load on the entire device. When the device is wedged or cammed into position, adjacent opposing cams push against the shaft in opposite directions and create such a bending force. It can be demonstrated trigonometrically that if a climbing anchor is to bear a vertical load equal to that created by a hard fall as described above, each individual cam element of a device using four cam elements is subject to a compressive force equal to the load on the entire device if the device is secured vertically between two parallel vertical walls where each of the camming elements contacts a wall with the point of contact being at an angle of approximately 14.5 degrees below horizontal from the pivot axis of the cam element. This figure assumes that the anchor is supported equally by all cam elements and the overall load is equally distributed.

Where an anchor is secured between vertical walls to support a load acting vertically, the table below shows the compressive load on a single cam and the vertical load on the same cam as those figures vary in relation to the angle formed between a horizontal line and a line passing through two points (1) where the cam element contacts a wall of the crack and (2) on the axis of the pivot shaft.

| Angle | vertical load on cam | total compressive load on cam |
|---|---|---|
| 10° | 250 units | 1440 units |
| 15° | 250 units | 966 units |
| 20° | 250 units | 731 units |

These figures assume that each cam element of a device with four cam elements is sustaining $\frac{1}{4}$ of a total load of 1000 units. For an anchor with only three cams, one cam must act alone to oppose the action of the other two cams and must therefore bear a load equal to the load of the other two cam elements combined, or one-half of the total load. The forces acting this single cam element of a three-cam anchor are potentially twice those acting upon any single cam of a device using four cam elements.

Regardless of the number of cam elements used, as opposing cam elements are moved farther apart from each other on the shaft or farther away from the support point of the shaft the bending effect of the opposing compressive forces applied by the cams transversely against the shaft becomes more pronounced. Under extreme conditions these bending forces can cause the shaft to deform enough to release the cams from their engagement with the rock. In contrast, where the cams are very close together the compressive force of the cams against the shaft becomes essentially a shear force across the shaft at the point between adjacent cams or at a point between a cam and the adjacent supporting structure and has little or no bending effect. Therefore, in order to minimize the potential bending of the shaft and to achieve the greatest structural integrity of an active camming device, it is desirable to position cams as close to each other and as close to the supporting structure of the shaft as possible.

While the present invention allows construction of a device of any size with a greater structural integrity than in the prior art, the greatest benefit is derived when the construction of the invention is applied to smaller devices. One of the primary limiting factors in the construction of camming anchors suited to placement in very narrow cracks is the correspondence between size and strength. By virtue of the greater inherent strength and resistance to deformation of the shaft of a device constructed according to the present invention, devices can be made smaller by downsizing the pivot shaft and other components without compromising the strength of the such a device to the extent which would be required when using the structure of prior art devices.

The helical biasing springs of the prior art devices are essentially wound into cylindrical shapes of a fixed radius in which the spring ends are at opposite ends of the cylindrical shape. The present invention provides a spring which is essentially wound in an open planar spiral so that each of the ends of the active portion of the spring moves in the same plane as the spring is tightened or loosened and the spring wire portions of adjacent spiral turns do not interfere with one another. As used herein the term "spiral" refers to such a flat planar spiral and is intended to distinguish such a flat spiral from the helical structure of the biasing springs of the prior art. Because of the essentially coplanar movement of the spring ends there is no force acting upon the spring off-center and no tendency for the spring to twist away from its axis. In contrast, this off-axis twisting in a prior art helical spring can cause a binding action which inhibits the freedom of motion of the spring or cam elements attached thereto. The consistency and smoothness of the spring movement of the present invention is further enhanced by positioning the spring between the smooth parallel walls of a recess or slot within a cam element where such walls are spaced only slightly wider apart than the diameter of the spring wire used. With such a construction, the walls of the recess serve to further keep the coils of the spring in the same plane. The consistency of the biasing action of the spring means is further enhanced since each cam element has an independent biasing means. Furthermore by locating each spring within a cam element the spring is protected from abrasion or other physical damage to which it might otherwise be exposed. Having the spring hidden from view also improves the general appearance of the device.

It is an object of the present invention to provide a climbing anchor in which the cam elements are spaced as closely as possible so that bending forces on the cam supporting shaft when the anchor is under load are minimized.

It is another object of the present invention to provide a climbing anchor in which the head is as axially compact as possible to allow its use in a wider variety of placements.

It is a further object of the invention to provide a spring biased camming device in which there is less opportunity for any binding of the spring or cam and in which the action of the spring is as consistent as possible.

Another object of the invention to provide a spring biased camming device in which each cam element is independently spring biased.

It is still another object of the present invention to provide a climbing anchor in which the biasing means of the camming elements is protected from physical damage and from the intrusion of foreign material.

A further object of the invention is to provide a climbing anchor in which the axial spacing of the cam elements may be independent of the configuration and location of the cam biasing springs.

Another object of the invention is to provide a climbing anchor with an improved visual appearance.

DESCRIPTION OF THE DRAWINGS

FIG. 3 is a perspective view of a cam element of the preferred embodiment showing hidden detail.

FIG. 4 is a side view of the biasing spring of the preferred embodiment.

FIG. 5 is a perspective view of a cam element of the preferred embodiment with its spring in place.

FIG. 6 is a perspective view of a section of the pivot shaft upon which the cams are mounted showing detail of the keyway used to anchor the biasing springs.

FIG. 7 is a perspective view of a cam element of the preferred embodiment in position on the pivot shaft with its internal biasing spring engaged with the shaft.

FIG. 8 is a perspective view of a section of the screw which forms the pivot shaft upon which the cam elements are mounted showing its socket head and the keyway used to engage the biasing springs.

DESCRIPTION OF THE PREFERRED EMBODIMENT

Figure 1:
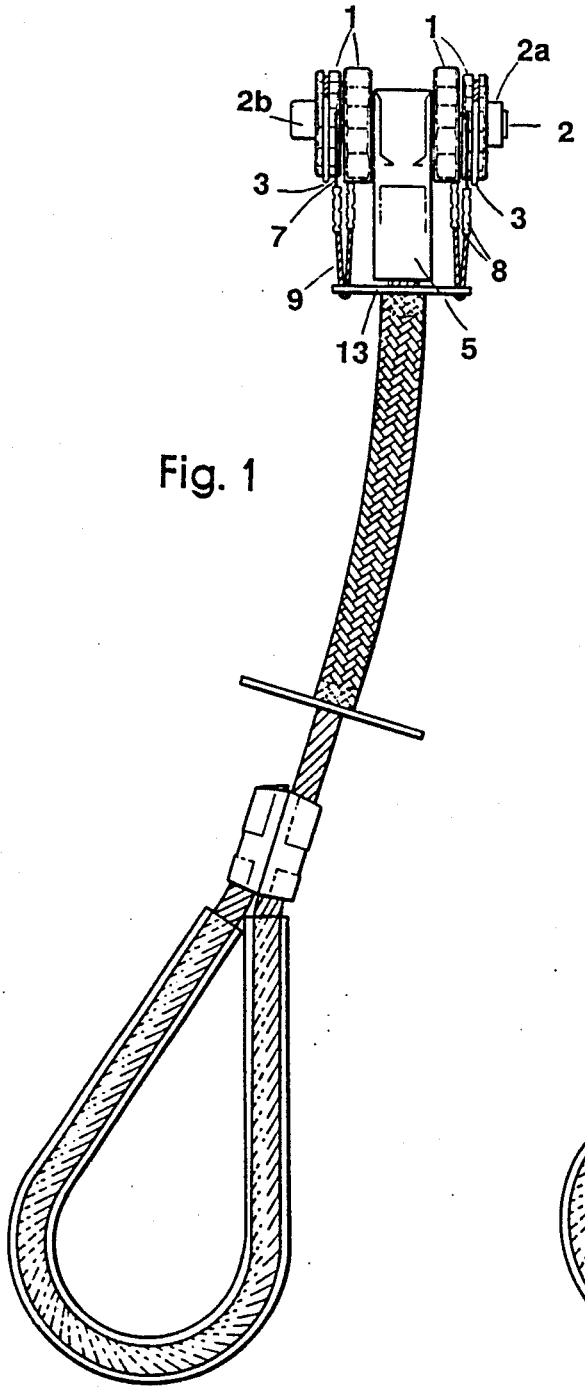
FIG. 1 shows a climbing anchor with a camming head constructed according to the present invention.
Figure 2:
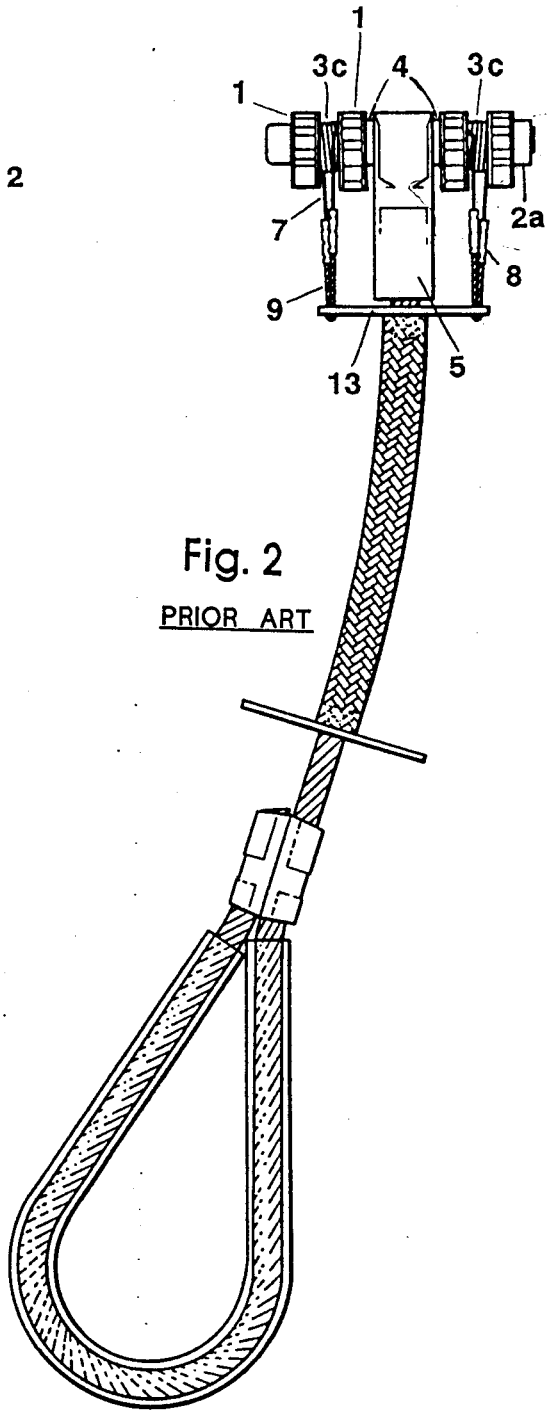
Fig. 2 PRIOR ART
FIG. 2 shows a climbing anchor similar to that shown in FIG. 1 but with a camming head constructed according to the prior art using helical springs.

According to the present invention, the anchoring device in FIG. 1 comprises a camming means in the form of a multiple-cam head having multiple camming elements 1 mounted in two pairs. Each cam element is pivotably supported on a main axle 2 which passes through cylindrical hole 12 and forms a pivot means. Main axle 2 is in turn fixed to the head supporting body 5. Each camming element is generally shaped with a curved multi-faceted rock engaging face 1*a* which has an increasing radius as measured from the pivot axis of the camming element on the axle 2 and a flat face 1*b* extending generally perpendicular to the facet on face 1*a* at the largest radius. Each of the several camming elements 1 is identical in size and shape for any single device. Although each device can be used as an anchor in cracks with widths over a selected range, the size of the camming elements may be varied from one device to another to allow different devices to serve as anchors in varying ranges of crack sizes which may be encountered while climbing. The camming elements 1 are machined from 6061 T6 aluminum alloy which is desirable because of its relatively light weight and malleablilty. This malleability aids in the grip of the cam elements when in place against a rock surface by allowing a very slight conformance of the surface of the cam elements to the surface of the rock. These elements could be made of any solid material of sufficient strength which would not deform significantly under the pressure created on the surface of the element by the camming action resulting from the load bearing of the device. Each cam element is provided with a narrow recess 11, the plane of which is perpendicular to the axle 2 upon which the cam element pivots. The recess 11 may be cut using an ordinary slotting cutter with a width of approximately 0.032 in. While the recess may be most easily cut with a straight bottom as shown in FIG. 3, it may also be cut in a curved bottom configuration, such as that shown in FIG. 9. A curved cut as shown has the benefits of being more closely conformed to the generally curved shape of the spiral spring. Furthermore such a curved recess avoids having any of the recess exposed on the camming surface la of a cam element and helps prevent the entry of any foreign matter into the recess, for example, when such a device is used on rock such as sandstone which has a surface which may tend to crumble somewhat. "Thus a major portion of the spring is concealed or enclosed and protected on at least three sides thereof including, in all operating positions of the cam element, the parallel wall portions between which the spring lies as well as an overlying wall portion at the active surface 1*a* of the cam which is between the spring and the crevice wall portion engaged by the cam element." It is desirable to have the width of such recess be just slightly greater than the diameter of the spring wire used to form flat spirally coiled biasing springs 3 so as to allow free movement of the spring while keeping a sufficiently tight fit to allow the flat smooth parallel walls of the recess to serve as a guide which keeps each spirally coiled spring 3 essentially in one plane. In no case should the recess be large enough to allow two widths of wire to pass by one another nor to allow adjacent turns of wire to wedge together between walls of the recess. Typically the walls of the recess are spaced on the order of 0.003–0.010 in. wider than the diameter of the spring wire used.

Figure 9:
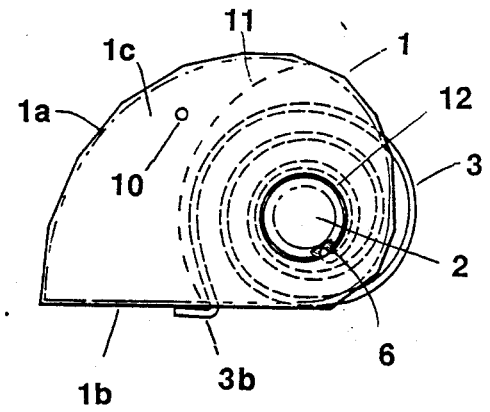
FIG. 9 is a plan view of a cam element of the preferred embodiment in its open position mounted on a pivot shaft and showing hidden detail of the biasing spring of FIG. 4 as it is positioned within the cam element and keyed to the shaft.

The axle 2 is a grade 8 chrome-moly steel alloy screw into which a longitudinal keyway or slot 6 is cut using a woodruff cutting tool. This keyway 6 is typically 0.040 in. deep and 0.060 in. wide. Alternately, in place of a longitudinal slot, single holes or recesses can be bored to correspond to the points at which the ends of the flat spiral springs will be secured. The axle has a socket head 2*b* at one end and is secured at the opposite end by a round threaded nut 2*a*. The end of the axle is preferably staked, peened or otherwise deformed after the nut is in place so as to fix the nut permanently. Each camming element is spring-biased toward its open position by means of the force of the spring 3 of FIG. 4 which is wound spirally in a single plane coiled around the axle between the walls of the recess 11 of a cam element and having one end 3*a* bent inwardly in the plane of the spring so as to fit into the keyway 6 on the axle shaft 2 as shown in FIG. 9. The opposite end 3*b* of the wire is also given an outward approximately right-angled bend in the same plane so that it can securely engage the flat face 1*b* of its corresponding cam element with a hooking action. This spring is constructed of spring steel wire ("piano-wire") of a diameter of 0.020–0.029 in., depending on the size of the cam elements 1 which will be used in a particular device, by winding such wire tightly around a form which keeps each succeeding wrap in the same plane and concentric with any preceding wraps. A simple version of such a form can be constructed using a threaded shaft with a head at one end similar in diameter to the shaft upon which the spring will ultimately be mounted and into which a diametric slot has been cut over the length of the shaft. The end of a length of the spring steel wire to be used is inserted into the slot. A nut or other similar collar-like device is then threaded up against the wire from the end of the shaft opposite the head so as to create a space just slightly larger than the diameter of the wire between the head of the threaded shaft and the nut. The wire is then wound tightly in concentric coils within this space so that, when released from the winding form, the coiled wire springs open slightly to the open spiral shape shown in FIG. 10 and the inner end of the wire retains the inward right-angled bend *3a* shown in FIG. 4 to allow it to be engaged in the slotted keyway of the shaft 2 upon which the cam element 1 is mounted. As seen in FIG. 6 a portion of one turn of the spring is exposed when the cam size is relatively small, particularly when the spring is unstressed. As the spring is rotated and put into a stressed condition its overall outside dimension will tend to decrease. Typically three full coils of the spring wire are sufficient to provide the range of motion and suitable torsional spring resistance for the purposes described herein. The number of wraps can be varied to allow construction of a spring with a particular physical size. Also, a greater number of coils provides for a greater range of motion and may also be desirable to lessen the torsional resistance when wire of a heavier gauge is used. Conversely, a lesser number of coils provides for a stiffer torsional action with a given wire gauge and may, therefore, be desirable where a lighter gauge of wire is used.

Figure 10:
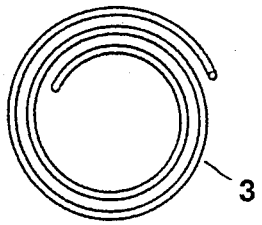
FIG. 10 is a side view of the biasing spring of an alternative embodiment in which two adjacent cam elements are biased against each other and in which the spring ends are bent perpendicular to the plane of the spring.

Each pair of camming elements 1 is separated from the head supporting member 5 by a thin circular washer 4 constructed of metal or plastic which is positioned on the axle to minimize frictional interference between the head securing member 5 and the adjacent camming element 1 on either side. Such a washer is also located on the shaft 2 between adjacent cam elements 1. In the preferred embodiment, this washer is of a nominal thickness of 0.010 in. The extreme thinness of this washer allows minimization of the space between adjacent cam elements 1 and a corresponding decrease in the axial length of the camming head. By minimizing the gap between adjacent cam elements 1 the possibility of grit or particles of rock dirt or sand becoming wedged therebetween is also minimized. I n a n alternative embodiment, the flat spiral spring 3 of FIG. 10 would be positioned between adjacent cam elements and have its respective ends bent outward, perpendicular to the plane of the spring and in opposite directions, each end engaging a hole or recess in the side 1*c* of the corresponding cam element. Such a spring would bias the adjacent cam elements in opposite directions and against each other. It is also obvious from this alternative construction that a functional biasing means can be constructed in which either the inner or outer end of a flat spiral spring can be engaged with a cam element. This alternative construction would also allow such a thin flat spring 3 to be substituted for the circular friction reducing washer 4 described above or, if wound in a spiral with an innermost wrap of wire at a larger radius as shown in FIG. 10, could be located around and concentric with a washer 4 which would then preferably have a thickness slightly greater than the diameter of the spring wire. These alternate constructions would retain most of the benefit of the axial thinness of the camming head afforded by having a flat spiral spring recessed within a cam element.

Each camming element is actuated by a length of thin but rigid wire 7 which is bent approximately perpendicular to its length to pass through a hole 10 in the camming element and which is free to pivot within the hole. The free end of the wire is further bent approximately perpendicular to the section of wire which passes through the hole 10 so as to prevent the wire from slipping out of said hole. The opposite ends of the rigid wires 7 from each pair of two adjacent camming elements are crimped with a malleable connector 8 to opposite ends of a flexible cable 9 which is attached to the cam actuating plate 13 by looping through two holes at one end of the plate.

Other variations within the scope of this invention will be apparent from the described embodiment and it is intended that the present descriptions be illustrative of the inventive features encompassed by the appended claims.

What is claimed is:

1. A climbing anchor comprising at least one camming element with spring biasing means to urge said element to its open position, a fixed pivot means comprising a pivot axle portion for each camming element, said camming element being pivotably mounted on its respective axle portion, wherein each spring biasing means comprises for each camming element a spring acting in a torsional fashion, each said spring having two ends, there being means at a first said end for engaging said spring with said cam element and there being means at the second said end for engaging said spring with the respective axle portion means whereby the spring biases the camming element relative to the fixed pivot means toward the open position of the camming element.

2. A climbing anchor according to claim 1, wherein the spring biasing means comprises a flat spring means configured essentially in a single plane.

3. A climbing anchor according to claim 2 wherein at least most of said spring means is located within a recess in said camming element.

4. A climbing anchor according to claim 1, wherein the spring biasing means comprises a coiled spring means spirally wound essentially in a single plane.

5. A climbing anchor according to claim 4 wherein at least most of said spring means is located within a recess in said camming element.

6. A climbing anchor according to claim 5 wherein said recess is a slot in said element extending generally perpendicular to the pivot axis of said element.

7. A climbing anchor according to claim 6 wherein said element has a surface for engaging the wall of a crevice in which the climbing anchor is inserted, said surface having crevice-wall-engaging portions of increasing radial distances from the axis of said pivot means, said slot being configured so that it does not extend to the crevice-wall-engaging surface portions of the element.

8. An improved climbing anchor comprising a frame structure including a supporting body with pivot means fixed to said body, at least one camming element pivotably mounted on said pivot means, spring biasing means acting between said frame structure and each such camming element to urge said element to its open position, said spring biasing means comprising for each element a coiled spring; configured in essentially one plane, encircling said pivot means and acting in a torsional fashion.

9. An improved climbing anchor according to claim 8 wherein said camming element has a slot therein within which most of said spring lies.

10. An improved climbing anchor according to claim 8 comprising a plurality of camming elements on said pivot means, wherein each said camming element has a slot therein within which most of the spring therefor lies.

11. An improved climbing anchor according to claim 8 wherein said spring is a flat spiral having two ends.

12. An improved climbing anchor according to claim 11 wherein one end of said spring is anchored to said pivot means and the other end is connected to said camming element.

13. An improved climbing anchor according to claim 8 wherein said element has a recess within which most of said spring is concealed.

14. An improved climbing anchor according to claim 8 comprising two camming elements adjacent to and operating in opposition to one another, a first end of the spring being secured to a first of said opposing cam elements and the other end being secured to the second of said camming elements to bias said first and second camming elements against each other.

15. A camming element for climbing anchor, said element comprising a surface for engaging the wall of a crevice in which the climbing anchor is inserted, said element having a recess, said recess being configured to essentially totally receive within said element at least a major portion of a spring for biasing said element relative to the anchor, said recess comprising wall portions of said camming element for enclosing and protecting said spring portion on at least three sides thereof including, in all operating positions of the camming element, a wall portion between said spring portion and the surface of the camming element which engages the wall of the crevice.

16. A camming element according to claim 15 wherein said element comprises a cylindrical hole for pivotably mounting the element on said anchor.

17. A camming element according to claim 16 wherein said surface has crevice-wall-engaging portions of increasing radial distances from the axis of said hole.

18. A camming element according to claim 17 wherein said recess is a slot in said element extending essentially perpendicular to the axis of said hole.

19. A camming element according to claim 18 wherein said slot has smooth closely spaced parallel walls for retaining a flat spiral spring therebetween.

20. A camming element according to claim 18 wherein said slot does not extend to the crevice-wall-engaging surface portions of the element.

21. An improved climbing anchor comprising a frame structure including a supporting body with pivot means fixed to said body, at least one camming element pivotably mounted on said pivot means, spring biasing means acting on each such camming element to urge said element to its open position, said spring biasing means comprising for each element a coiled spring encircling the axis of said pivot means and acting in a torsional fashion, said frame structure and each said camming element having integral bearing surfaces encircling the pivot means to limit movement of each camming element in both directions axially of the pivot means, said anchor including means for each such spring defining a recess to receive at least part of the coiled portion of said spring, said recess being at all times greater than the axial dimension of said coiled portion to prevent binding of the spring in said recess when a force is exerted on a camming element in a direction generally parallel to the axis of the pivot means and toward its biasing spring.

22. An improved climbing anchor according to claim 21 wherein each said recess is formed in a camming element.

23. An improved climbing anchor according to claim 21 wherein each said recess is a slot formed in a camming element.

24. A climbing anchor comprising a plurality of camming element with spring biasing means to urge each camming element to its open position, an axle means, each camming element being pivotably mounted on said axle means for rotation about an axis, each camming element having a slot therein generally perpendicular to its axis, said spring biasing means comprising each camming element a torsionally acting spiral spring coiled in essentially one plane perpendicular to and encircling the axis of the camming element in said slot and essentially totally enclosed in the slot, each said spring having two ends, there being means at a first said end for engaging said spring with the camming element and there being means at the second said end for engaging said spring with the axle means whereby the spring rotationally biases the camming element about its axis to its open position, the structure of said axle means, said cam elements and said spring means being such that there is no binding of any coiled spring portion in its respective slot when a force is exerted on a camming element, in a direction generally parallel to its axis.

* * * * *